United States Patent [19]

Ballestrazzi et al.

[11] 4,182,096

[45] Jan. 8, 1980

[54] MACHINE FOR WRAPPING LIGHT OBJECTS, FOR EXAMPLE PAPER CUPS, IN FLEXIBLE PLASTICS WRAPPERS

[75] Inventors: Aris Ballestrazzi; Lamberto Tassi; Gianni Tosarelli, all of Vignola, Italy

[73] Assignee: Sitma S.p.A. Societa Italiana Macchine Automatiche, Spilamberto, Italy

[21] Appl. No.: 887,775

[22] Filed: Mar. 17, 1978

[30] Foreign Application Priority Data

Mar. 31, 1977 [IT] Italy ..... 21964 A/77

[51] Int. Cl.[2] ..... B65B 9/02

[52] U.S. Cl. ..... 53/553

[58] Field of Search ..... 53/547, 548, 553, 582, 53/589, 591

[56] References Cited

U.S. PATENT DOCUMENTS 3,928,941 12/1975 Singer ..... 53/553

3,990,215 11/1976 Elsner et al. ..... 53/553

*Primary Examiner*—Travis S. McGehee

*Attorney, Agent, or Firm*—Cushman, Darby & Cushman

[57] ABSTRACT

This invention relates to a packaging machine for wrapping light objects, for example paper cups in flexible plastics wrappers. The packaging machine according to the invention is of the general type including a cell conveyor for the objects, lower and upper plastics films respectively fed below and above the objects and welding and cutting means for joining said films together before each object by operating a double weld with intermediate cut. According to the invention, each cell of the conveyor is provided with at least one upper closing arm carrying an idle roller for the lower film and resiliently retained in cell closing position, there being provided first and second cam means acting on said arm to cause momentary displacements thereof into cell opening position when each cell passes through loading and discharge regions respectively upstream and downstream of the film joining region.

3 Claims, 7 Drawing Figures

MACHINE FOR WRAPPING LIGHT OBJECTS, FOR EXAMPLE PAPER CUPS, IN FLEXIBLE PLASTICS WRAPPERS

This invention relates to a packaging machine for wrapping light objects, for example paper cups, in flexible plastics wrappers.

Packaging machines are known for providing objects of various kinds with a flexible plastics wrapper by inserting them between two superimposed films which are welded together with a double weld and cut in an intermediate position, between one and the other of the objects to be wrapped. These latter are usually housed in respective cells in an intermittently operated conveyor, and the lower of the two wrapping films is disposed taut over the initial portion of its horizontal working branch (obviously below the conveyed objects). The upper film descends from above to mate with the lower film at the double weld, which is made in front of each object conveyed.

These machines, and in particular the cell conveyor which they include, have up to the present time proved perfectly suitable for wrapping heavy objects, the position of which in the respective cells does not change during conveying. However, various problems have arisen when the same machines have been used for wrapping light objects, as for example paper cups. In this respect, it has been found that objects which are too light do not remain at rest in the respective cells, and in fact tend to emerge from them, possibly due to the effect of modest thrusts in the relevant direction caused by the slight state of tension in which the film disposed between the objects to be packaged and conveyed ca lie.

The main object of the present invention is to provide a machine of the aforesaid general type, which is adapted in such a manner as to make it perfectly suitable for wrapping light objects, as for example paper or plastics cups, rolls of wallpaper and rolls of patterned paper in general.

According to the invention this object is attained by a packaging machine comprising an intermittently operated conveyor with a succession of cells for containing objects to be wrapped, a lower flexible plastics film fed below said objects and over an initial portion of a horizontal working branch of said conveyor, an upper flexible plastics film fed from above towards a predetermined region of said working branch of the conveyor, and welding and cutting means operating in said predetermined region for joining said films together between one cell and another by welding together with a double weld and cutting in an intermediate position, wherein at least one upper closing arm carrying an idle roller for said lower film is associated with each conveyor cell, there being provided resilient means for retaining said arm in its closing position, first cam means arranged to act on a portion of said arm to cause a momentary displacement thereof into its opening position when the cell with which it is associated passes into a loading region for the objects to be packaged upstream of said film joining region, and second cam means arranged to act on a portion of said arm to cause a further momentary displacement thereof into its opening position when the cell with which it is associated passes into a discharge region for the packaged objects downstream of said film joining region.

In other words, in the packaging machine according to the invention, the cells containing the objects to be packaged are closed upperly along their entire path from the loading region to the discharge region, with the obvious advantage of preventing any possibility of light objects emerging from their cells, and thus being perfectly suitable for packaging light objects as for example paper or plastics cups and rolls of wallpaper or patterned paper in general.

The closing arms are preferably constituted by rotatable levers, which are urged by suitable resilient means in such a manner as to normally maintain the idle roller resting on the body of the object to be packaged. The degree of closure of the cells is thus automatically adapted to the varying dimensions of the objects to be packaged.

It should be noted that after the double weld has been made between one conveyor cell and another, each individual object is enclosed in its own independent wrapper, which is open on two sides. To complete the closure of the wrapper it is obviously necessary to weld the wrapper laterally.

According to the invention, the lateral weld is made directly on the same machine, utilising for this purpose a second cell conveyor (but without closing arms) disposed at the outlet of the first, a pair of fixed support plates for the lateral edges of the wrappers, and a pair of welding elements arranged to cooperate with said fixed plates to weld said edges supported on said plates.

In a very simple manner, the machine according to the invention is thus able to prepare finished packages ready for despatch, or, if required, for insertion into a hot shrinkage tunnel.

These and further characteristics of the present invention will be more evident from the detailed description given hereinafter of one embodiment, illustrated by way of non-limiting example in the accompanying drawings in which.

Figure 1:
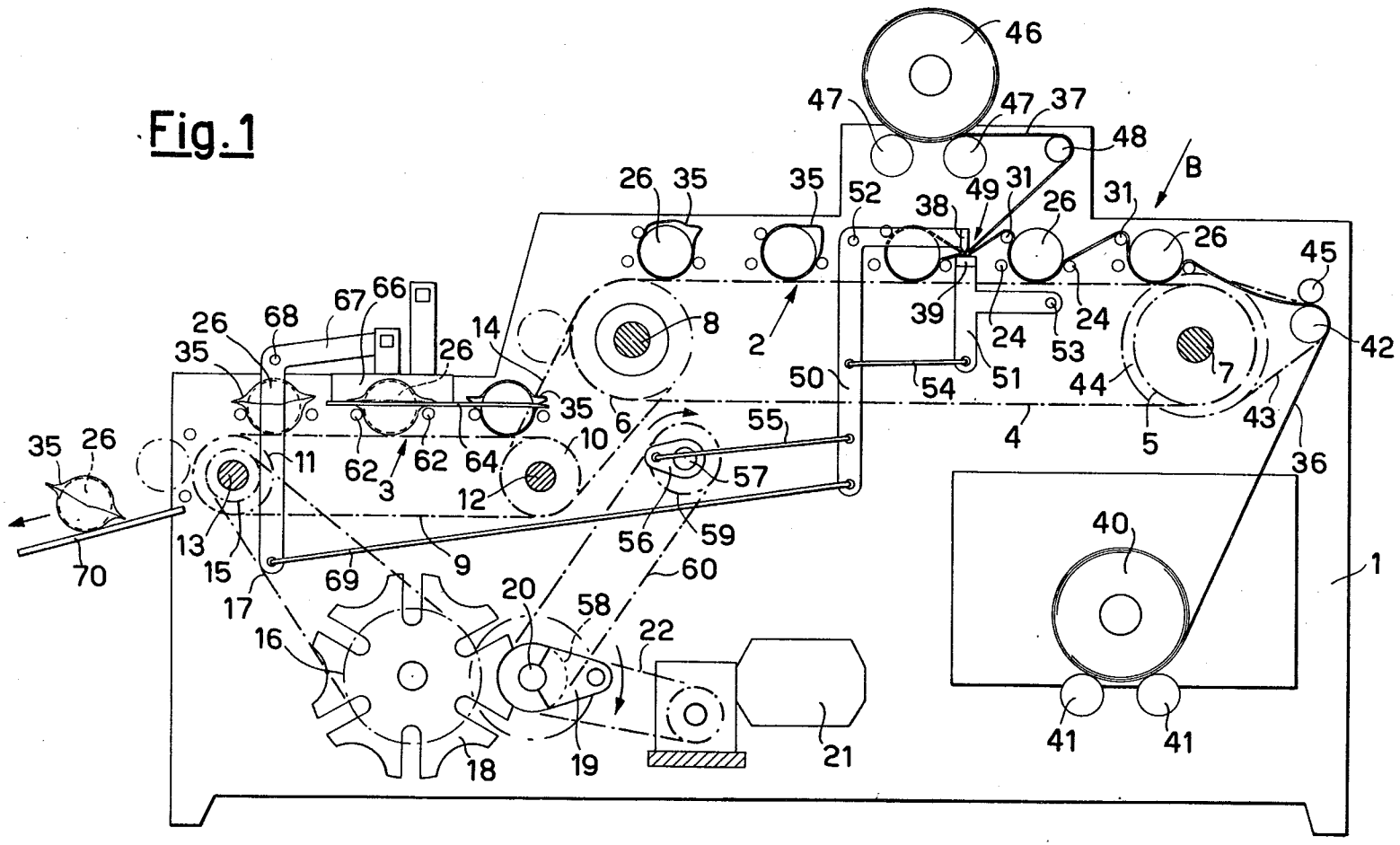
FIGS. 1 and 2 are diagrammatic representations of a packaging machine according to the invention in two different working positions.
Figure 2:
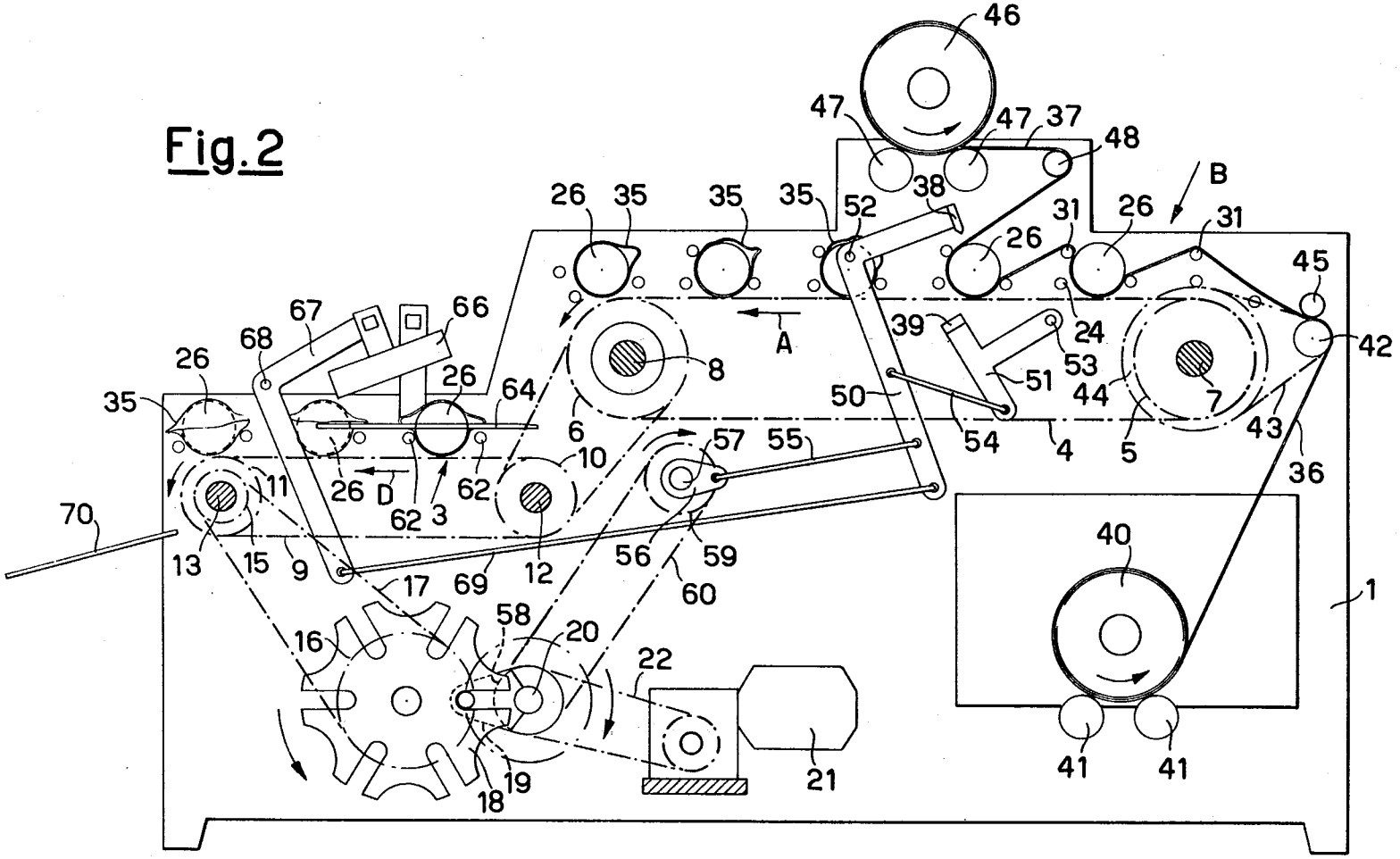

With reference to the overall diagrammatic representations of FIGS. 1 and 2, the packaging machine therein illustrated comprises a base frame 1, which supports two endless conveyors 2 and 3 at different heights. The conveyor 2 comprises a pair of chains 4 stretched between pairs of gear wheels 5 and 6 freely rotatable about respective shafts 7 and 8, and the conveyor 3 comprises a pair of chains 9 stretched between pairs of gear wheels 10 and 11 freely rotatable about respective shafts 12 and 13. A chain 14 kinematically connects together the two conveyors 2 and 3, the second of which is driven via two gear wheels 15 and 16 and a chain 17, by an intermittent motion mechanism formed by a Maltese cross wheel 18 and a crank 19 continuously rotated about a pivot 20 by a motor 21 via a drive chain 22.

Figure 3:
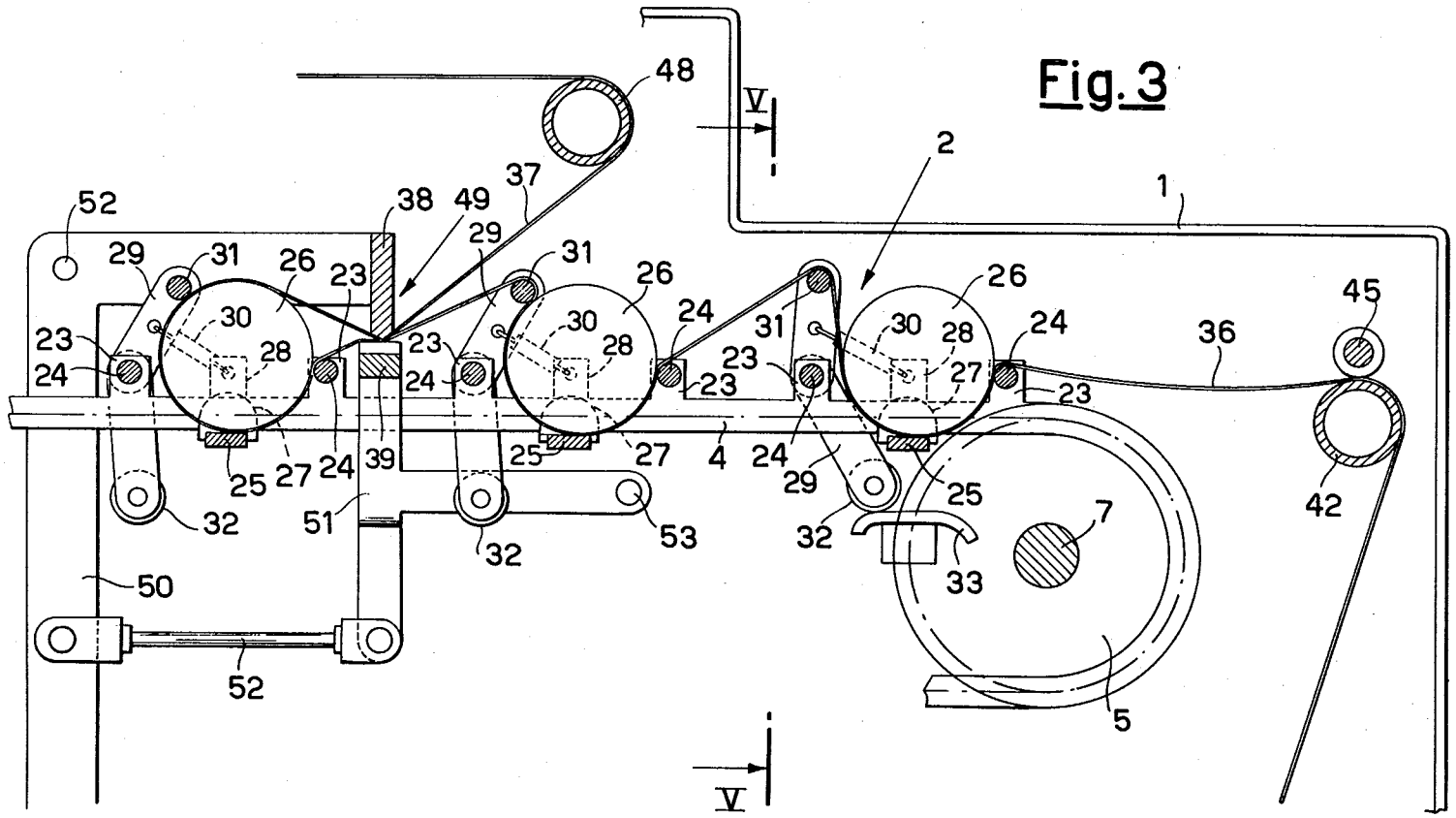
FIG. 3 is an enlarged longitudinal section through the closed cell conveyor of the machine shown in FIGS. 1 and 2 at the loading region for the objects to be packaged and the joining region for the two superimposed films.
Figure 4:
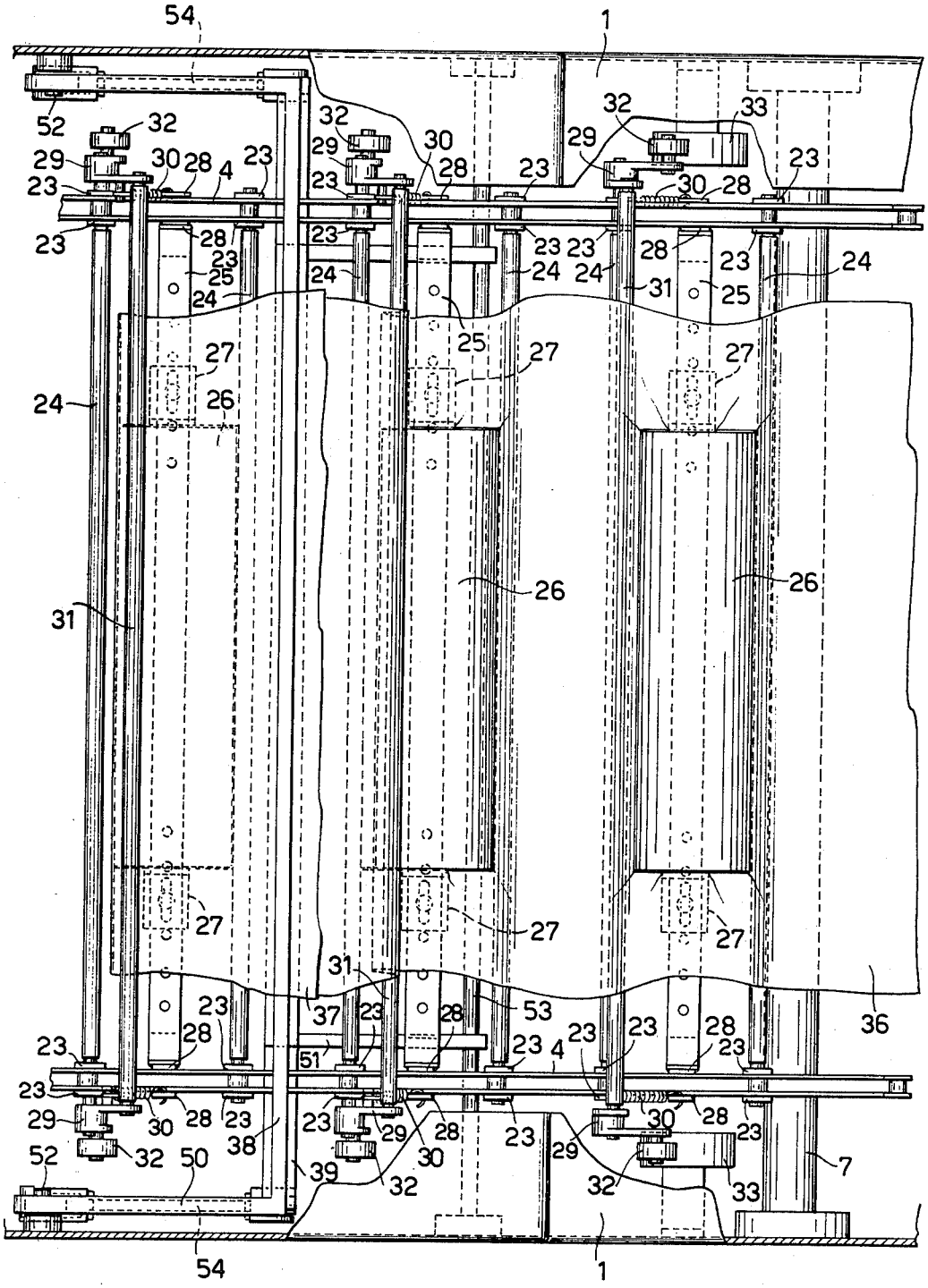
FIG. 4 is a plan view from above of the same conveyor portion as in FIG. 3.
Figure 5:
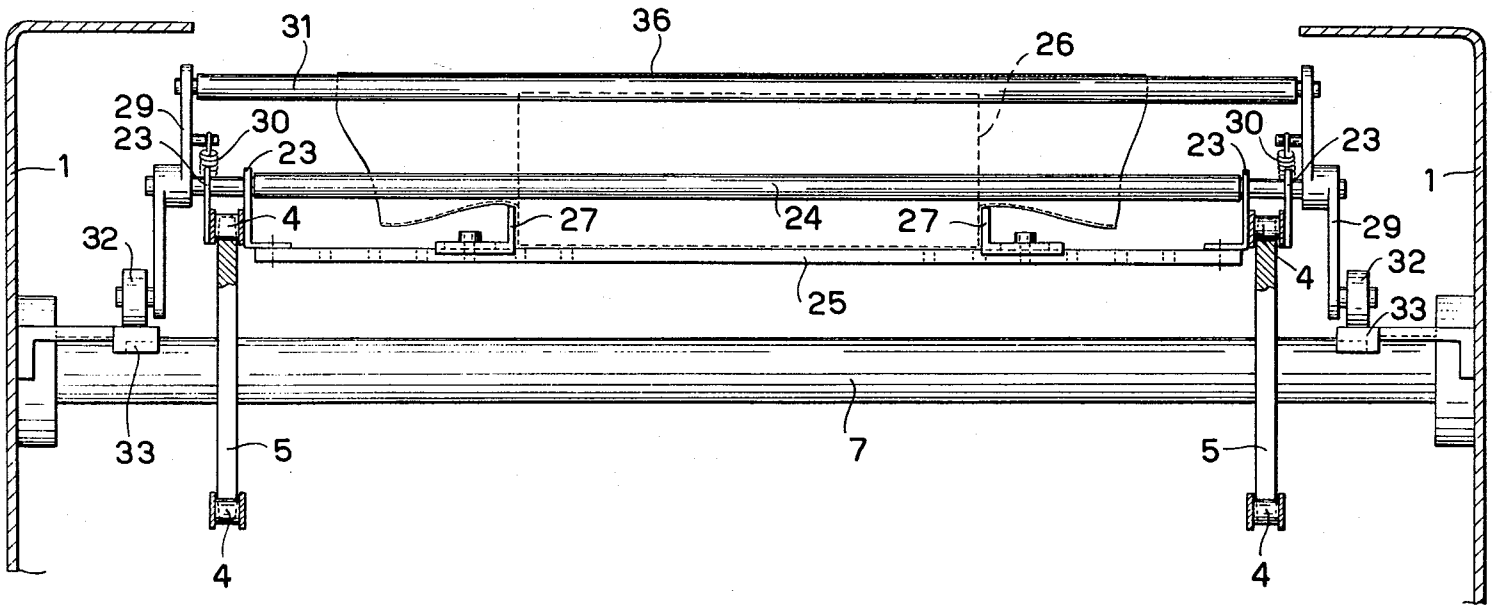
FIG. 5 is a cross-section through the same conveyor portion on the line V—V of FIG. 3.

As shown in greater detail in FIGS. 3, 4 and 5, each chain 4 of the conveyor 2 is provided with small upper uniformly spaced-apart appendices 23, which are connected to the corresponding appendices of the other chain by freely rotatable bars 24. In combination with support strips 25 carried by further appendices 28 fixed to the chains 4, each pair of adjacent bars 24 defines a respective cell for housing a respective object to be packaged, for example a paper or plastics cup or a roll of patterned paper or wallpaper, represented on the drawings as a cylindrical body 26. As shown in FIG. 5, a pair of brackets 27 fixed in an adjustable manner to each strip 25 laterally defines the position of the objects 26 in the respective cells of the conveyor 2.

Coaxially to the forward (with reference to the direction of movement of the conveyor 2 indicated by the arrow A in FIG. 2) of the two idle bars 23 which define the front and rear of each cell of the conveyor 2, there is mounted freely rotatably a pair of lever arms 29 which are resiliently urged by springs 30, acting between said arms and the appendices 28 of the chain 4, towards a position in which an idle roller 31 connecting said arms together rests on the body of the object to be packaged, and retains it in the respective cell, to determine in practice a condition of upper closure of this latter. At the lower end of each pair of arms 29 there is provided a further idle roller 32 arranged to engage with respective cams 33 (FIG. 3) and 34 (FIG. 6) at the inlet and outlet of the upper working branch of the conveyor 2, to determine the forced opening of the respective cell for loading objects to be packaged from above (arrow B in FIG. 1), and for transferring them to the conveyor 3 respectively (arrow C in FIG. 6).

For wrapping the objects 26 in respective sleeve wrappers 35 (visible in the left hand portion of the conveyor 2 in FIGS. 1 and 2) the closed cell conveyor 2 acts in cooperation with two flexible plastics films 36 and 37 and a welding and cutting device 49 constituted by a welder 38 and a counter-welder 39 which can be made to approach each other from opposite sides (one above and the other below) of the upper working branch of the conveyor 2.

The lower film 36, for example of polyethylene, unwinds from a large roll 40 supported freely rotatable by two idle rollers 41, utilising for this purpose the traction provided (at a speed slightly greater than that of the conveyor 2) by a withdrawal roller 42 (with a pressure roller 45) rotated synchronously by a drive chain 43 wound about a pinion 44 disposed coaxially to the gear wheel 5 and fixed thereto (FIG. 1). Downstream of said withdrawal roller 42, the lower film 36 engages in each cell of the conveyor 2, passing in particular above the rear bar 24, below the object to be packaged (but above the support strip 25), and finally above the idle roller 31 carried by the lever arms 29.

The upper film 37, also for example of polyethylene, unwinds from a large reel 46 supported freely rotatable by two idle rollers 47 which engage with an idle roller 48 before meeting the lower film 36 in the "joining" region, in which the welding and cutting device 49 operates. In this position, during the periodical halts of the conveyor 2 (FIGS. 1 and 3), the welder 38 in cooperation with the counter-welder 39 welds together the two superimposed films with a double transverse weld and cuts them therebetween, both to complete a sleeve wrapping 35 about the object 26 immediately downstream of the device 49, and to provide a head joint between the film 36 and 37 in front of the object 26 immediately upstream of the welding and cutting device 49 (FIG. 3).

As shown in FIGS. 1 and 2, the welder 38 and counter-welder 39, both of known type, are carried by respective support frames 50 and 51 which are rotatable about respective pivots 52 and 53 and are connected together by rods 54. A pair of tie rods 55 links the assembly formed by the two frames 50 and 51 to a pair of cranks 56 keyed on to a rotatable shaft 57 which is driven by the shaft 20 (driven, as stated, by the motor 21) via a transmission system constituted by two gear wheels 58 and 59 and a chain 60. The linkage is such that when the shaft 20 is rotated continuously at constant speed, the welder 38 and counter-welder 39 are made to approach each other and engage between one cell and another of the conveyor 2 when the crank 19 is disengaged from the Maltese cross 18 and the conveyors 2 and 3 are consequently at rest (FIG. 1), whereas they are made to withdraw so as not to obstruct the movement of the conveyor 2 when the crank 19 is engaged with the Maltese cross 18 and, by causing this latter to rotate through one step, equally causes the conveyors 2 and 3 to move forward through one step (in the direction indicated by the arrow D in FIG. 2).

Figure 6:
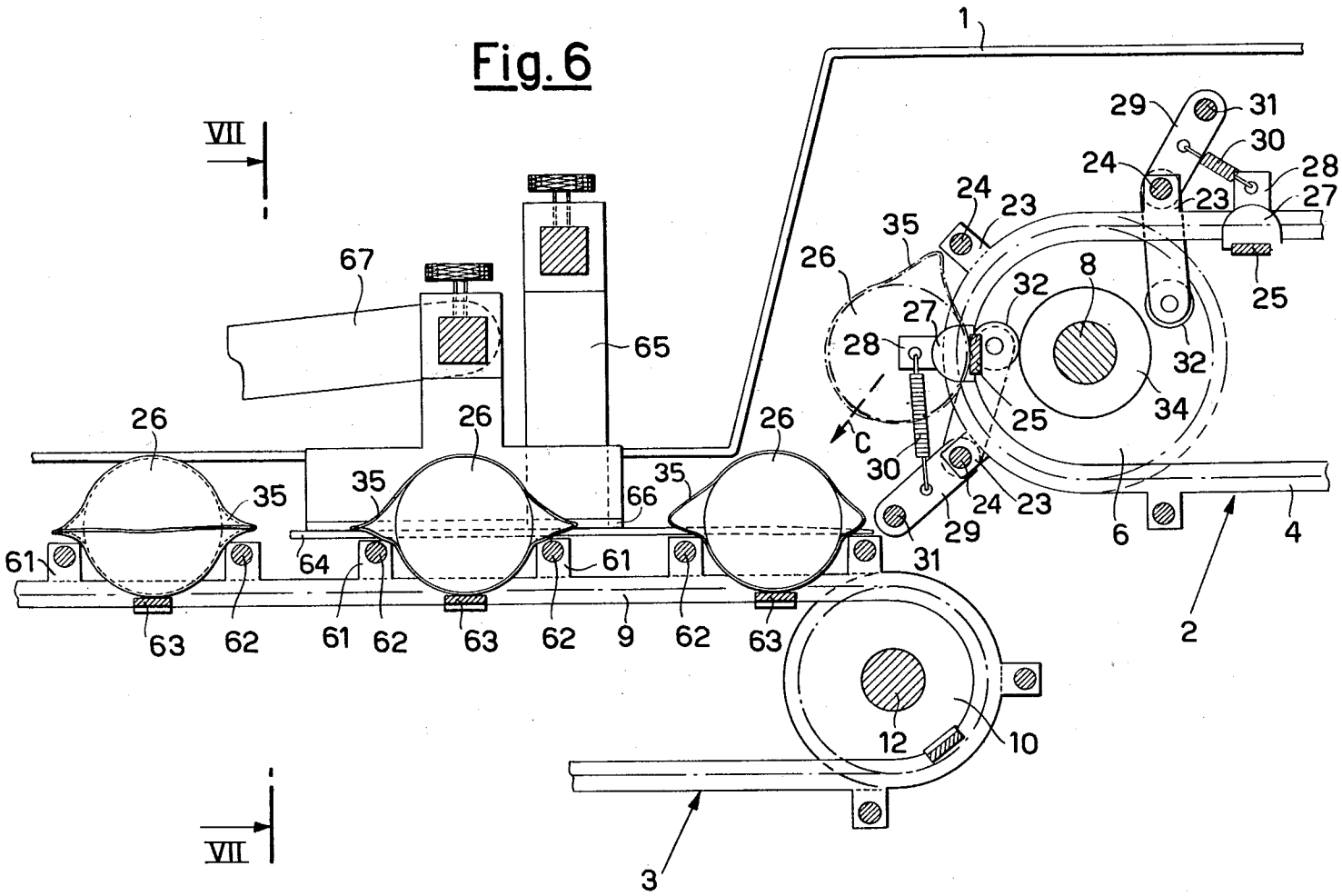
FIG. 6 is a longitudinal section through the region in which the packaged objects are transferred from the closed cell conveyor to the open cell conveyor, and the subsequent lateral welding region associated with this latter conveyor.
Figure 7:
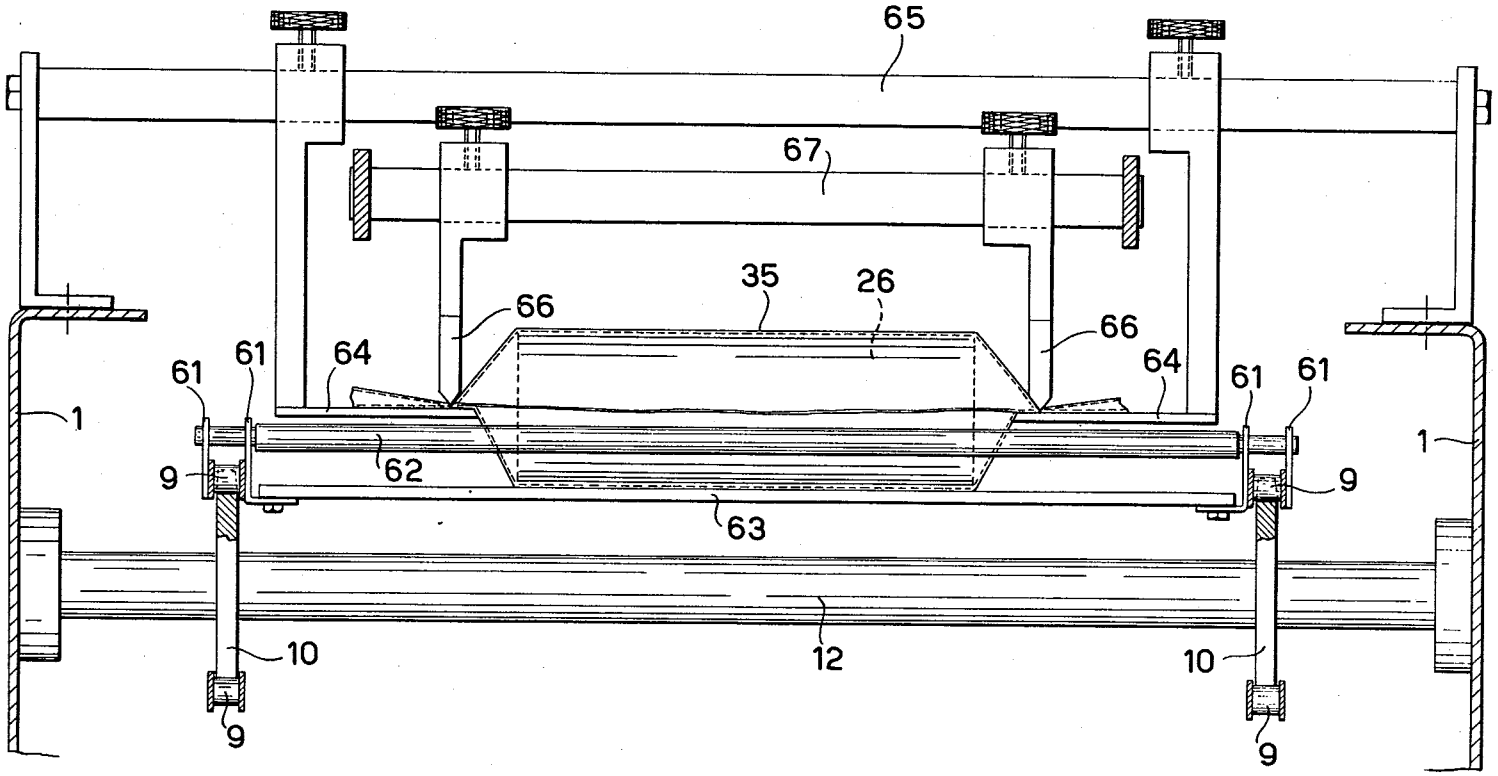
FIG. 7 is a cross-section through said open cell conveyor on the line VII—VII of FIG. 6.

As can be better seen in FIGS. 6 and 7, the conveyor 3 is in many ways similar to the conveyor 2, the only exception being the absence of the lever arms 29 and idle rollers 31, and the other elements connected to them such as the springs 30, appendices 28 and follower rollers 32. Finally, each chain 9 of the conveyor 3 is provided with a succession of small appendices 61 connected to those of the adjacent chain by idle bars 62, each pair of which, together with an interposed strip 63 also fixed to the chain 9, forms a respective cell (always open) for receiving the objects provided with a sleeve wrapper 35, which leave the conveyor 2 (FIG. 6).

At the two sides of the conveyor 3, a little above the idle bars 62 (FIG. 7), there is disposed a pair of plates 64 supported at a fixed height by a support frame 65 connected to the base frame 1 (FIG. 7). Said plates, which are adjustable transversely on said frame 65, are able to support the lateral edges, which have as yet not been welded, of the wrappers 35 disposed about the objects 26, to act during the halt periods of the conveyor 3 as counter-welding elements for a pair of welders 66 which are adjustable transversely on the frame 65 and arranged to laterally close the wrappers 35.

As shown in FIGS. 1, 2 and 7, the two welders 66 are carried by a frame 67, which is freely rotatable about a pivot 68 and is linked to the frame 50 of the welder 38 by rods 69, this linkage is such that the welders 66 engage with the plates 64 to make a weld when the welder 38 engages with the counter-welder 39 (FIG. 1), i.e. when the conveyors 2 and 3 are at rest, whereas they disengage from the plates 64 and withdraw from the path of the open cell conveyor 3 when the welder 38 withdraws from the counter-welder 39 (FIG. 2), i.e. when the conveyors 2 and 3 are operated.

Finally, the machine shown on the drawings is completed by a chute 70 disposed at the outlet of the conveyor 3 for discharging the wrapped objects (FIGS. 1 and 2).

The described structure operates in the following manner. The conveyors 2 and 3 are operated intermittently in the directions indicated by the arrows A and D in FIG. 2, with the lower film 36 resting on an initial portion of the upper working branch of the conveyor 2 and joined at its head to the upper film 37 at the welding and cutting device 47. The objects to be wrapped are then inserted one behind the other into respective cells in the conveyor 2, facilitated by the momentary opening of the lever arms 29 and relative idle rollers 31 at the loading region (arrow B in FIG. 1) by the engagement between their follower rollers 32 and the fixed cam 33 (FIG. 3). After loading, as shown in FIG. 3, the lever arms 29 disengage from the cam 33 and return to the closed position, where the idle rollers 31 rest on the objects in the cells, to prevent them from leaving.

The object, already partly wrapped in the lower film 36 which at any time is disposed immediately upstream of the cutting and welding device 49, utilises the forward step which accompanies the reopening of said device after any cutting and welding operation, to insert itself into the single film now formed by the joined films 36 and 37 (FIG. 2) and pass beyond the device 49. When the conveyor 2 is again stopped, this returns to its closed position (FIG. 3), and the welder 38 welds together the two portions of superimposed film behind the object which has just passed beyond it, by means of a double weld plus an intermediate cut, the effect of which is to form a sleeve wrapping 35 around the object immediately downstream of the welder and to leave the two films 36 and 37 again joined at their head in front of the following object.

The objects provided with the wrapper 35 proceed along their path to arrive at the outlet of the conveyor 2, where they are able, because of the momentary reopening of the lever arms 29 and idle rollers 31 determined by the cam 34, to fall in succession into respective permanently open cells in the conveyor 3 (FIG. 6). The open lateral edges of the wrappers 35 thus rest on the counter-welding plates 64 where they are then welded laterally by the welder 66.

A closed wrapper is thus completed around the objects 26, which are then discharged down the chute 70.

What we claim is:

1. A wrapping machine, comprising an intermittently operated conveyor with a succession of cells for containing objects to be wrapped, a lower flexible plastics film fed below said objects and over an initial portion of a horizontal working branch of said conveyor, an upper flexible plastics film fed from above towards a predetermined region of said working branch of the conveyor, and welding and cutting means operating in said predetermined region for joining said films together between one cell and another by welding together with a double weld and cutting in an intermediate position, wherein at least one upper closing arm carrying an idle roller for said lower film is associated with each conveyor cell, there being provided resilient means for retaining said arm in its closing position, first cam means arranged to act on a portion of said arm to cause a momentary displacement thereof into its opening position when the cell with which it is associated passes into a loading region for the objects to be packaged upstream of said film joining region, and second cam means arranged to act on a portion of said arm to cause a further momentary displacement thereof into its opening position when the cell with which it is associated passes into a discharge region for the packaged objects downstream of said film joining region.

2. A machine as claimed in claim 1, wherein said closing arms are constituted by levers rotatably pivoted to said conveyor and carrying said idle roller at their upper end, and a cam follower arranged to cooperate with said first and second cam means at their lower end.

3. A machine as claimed in claim 1, comprising a second open cell conveyor disposed at the outlet of the first mentioned conveyor, a pair of fixed plates disposed at the sides of said second conveyor for supporting the open lateral edges of the wrappers disposed about the objects which leave the first conveyor, and a pair of welders arranged to cooperate with said fixed plates to weld said lateral edges of the wrappers.

* * * * *